US005671883A

United States Patent [19]

Philips

[11] Patent Number: 5,671,883

[45] Date of Patent: Sep. 30, 1997

[54] QUICK COLLAPSE PAPERBOARD CONTAINER

[75] Inventor: Nicholas A. Philips, Chicago, Ill.

[73] Assignee: Weyerhaeuser Company, Tacoma, Wash.

[21] Appl. No.: 672,607

[22] Filed: Jun. 28, 1996

[51] Int. Cl.[6] ..... B65D 5/42

[52] U.S. Cl. ..... 229/236; 229/23 R

[58] Field of Search ..... 229/23 R, 236, 229/243, 122

[56] References Cited

U.S. PATENT DOCUMENTS

| | | | |
|---|---|---|---|
| 2,133,701 | 10/1938 | Holmes et al. | 229/236 |
| 2,301,309 | 11/1942 | Messer | 229/122 |
| 2,301,310 | 11/1942 | Messer | 229/23 R |
| 3,015,430 | 1/1962 | Bauer | 229/236 |
| 3,292,841 | 12/1966 | Donovan | 229/122 |
| 3,756,502 | 9/1973 | Swanson et al. | 229/122 |
| 3,891,137 | 6/1975 | Ellison et al. | 229/23 R |
| 5,011,021 | 4/1991 | Coltrane et al. | 229/122 |

*Primary Examiner*—Gary E. Elkins

[57] ABSTRACT

A paperboard container has opposed or weakened lines extending from top to bottom in a pair of end walls. The weakened lines are spaced inwardly from the corners of the container. To collapse the container for retrieval and recycling the tops of the end walls are grasped and sufficient force exerted causing the weakened lines to tear from top to bottom.

3 Claims, 2 Drawing Sheets

Fig. 2
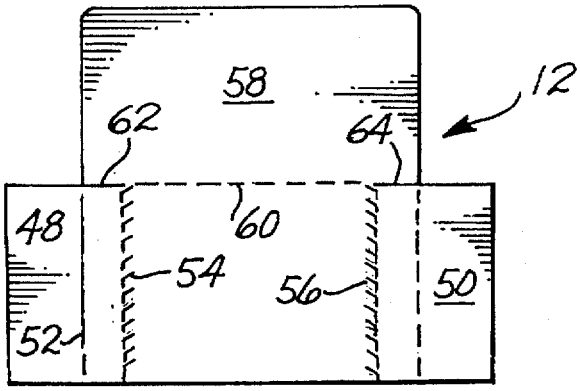
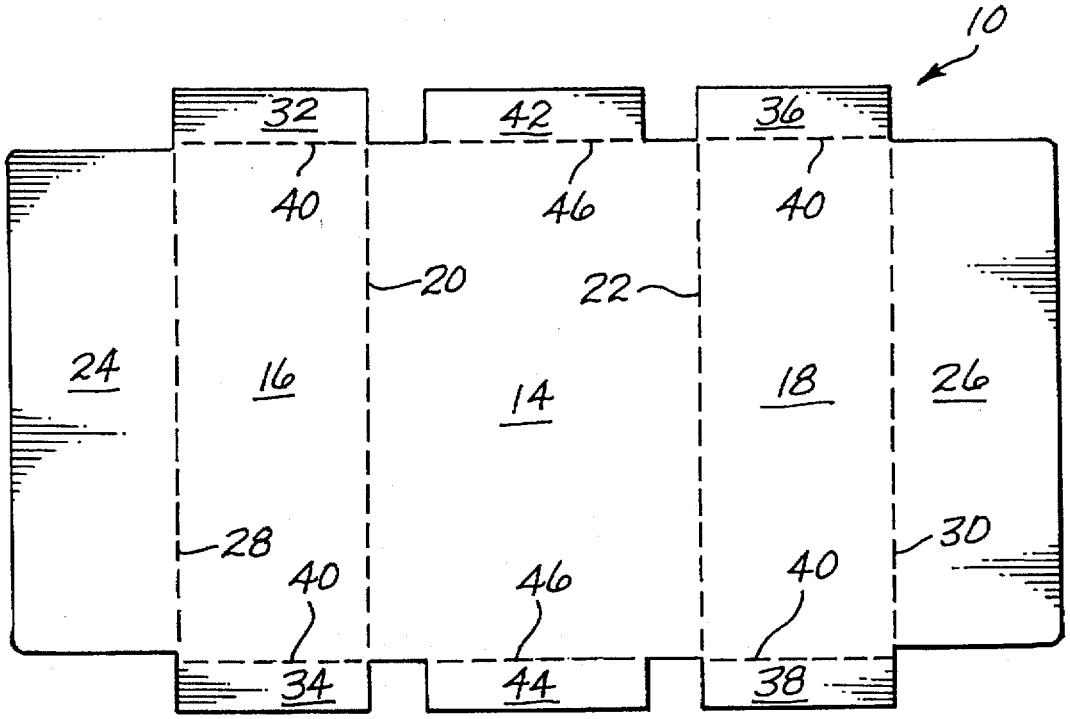
Fig. 1
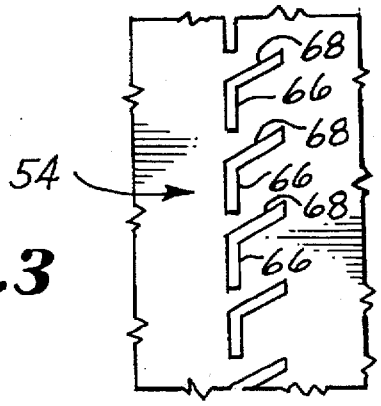
Fig. 3

Fig. 4
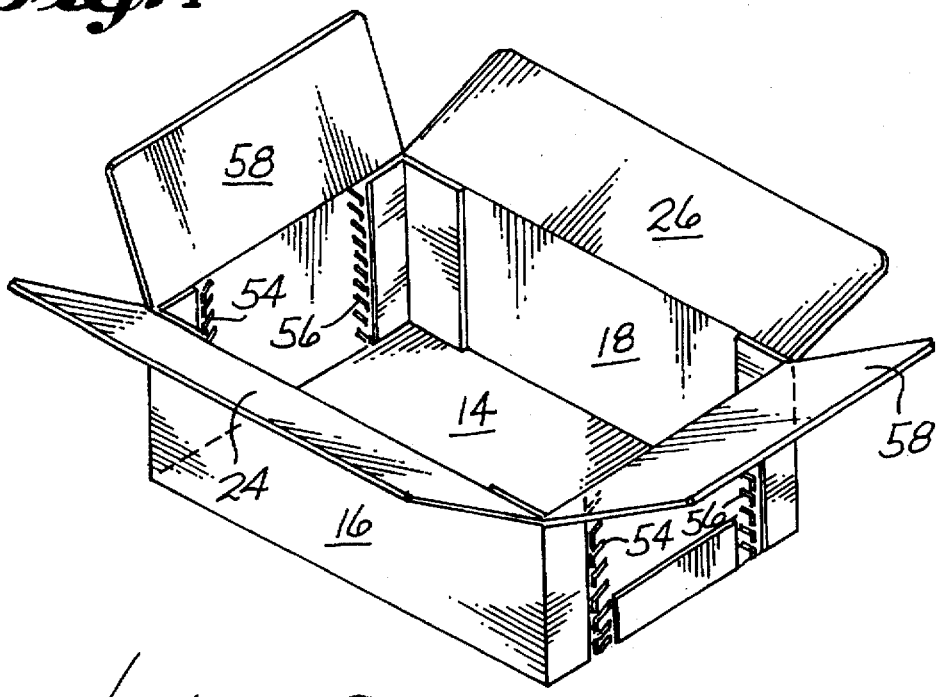
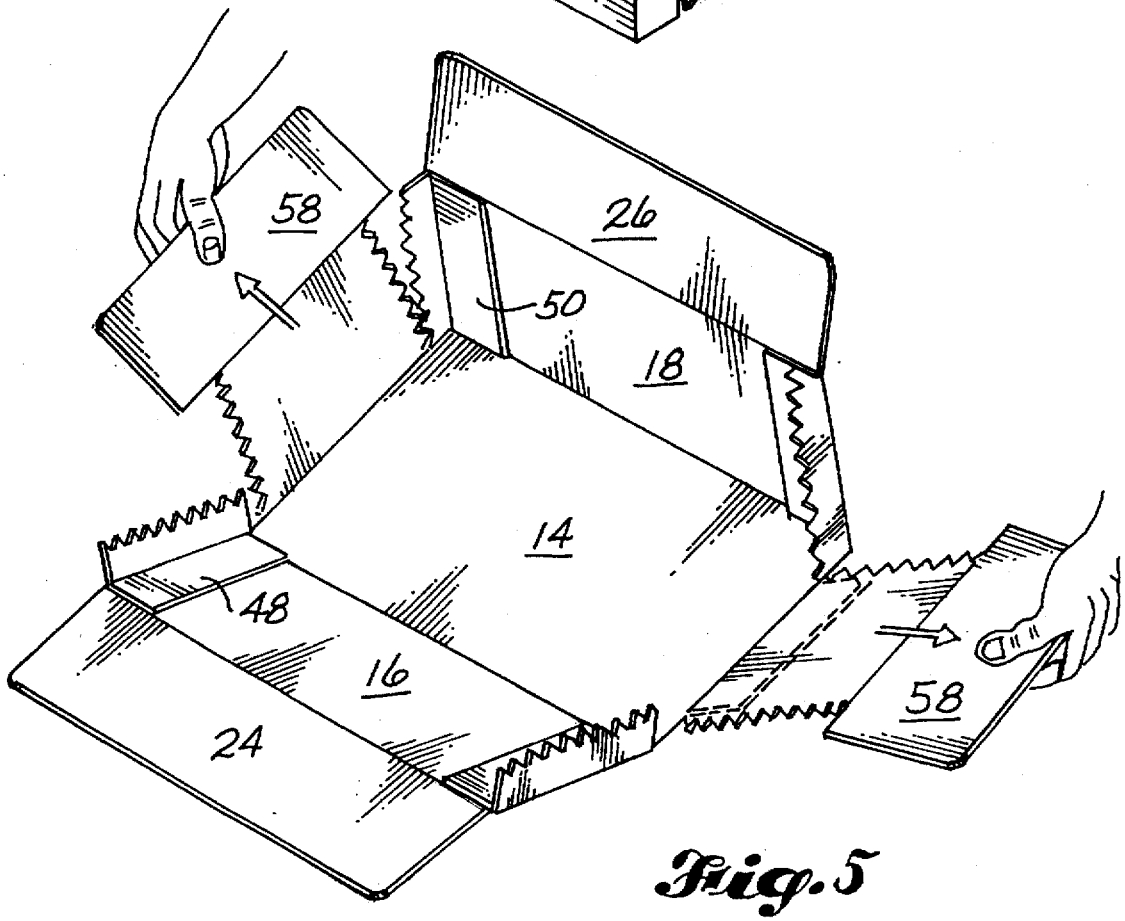
Fig. 5

QUICK COLLAPSE PAPERBOARD CONTAINER

BACKGROUND OF THE INVENTION

This invention relates generally to paperboard containers and more particularly to a paperboard container that has high stacking strength but has structural elements incorporated in the container to readily permit collapsing, after use, to a flat container.

Paperboard containers can be produced with high stacking strength, usually by configuring end walls with heavy duty paperboard, multiple layers, or other strength enhancing means such as corner panels to create additional supporting columns. Many of these containers are designed with the required strength properties (vertical top to bottom stacking strength) and with the ability to be formed (erected) on a machine. As will be well understood by those skilled in paperboard container manufacture, flat paperboard blanks are cut, scored and configured into the elements of the container which is then erected either by hand or by machine. Some containers are formed from single piece blanks while others are formed from multiple pieces (for example, a bliss style with two separate end walls attached to a body member).

As more machine formed, high stacking strength containers are being used, concern has increased over the difficulties of collapsing these styles where mechanical compactors are not available. The motivation to collapse containers after use is, of course, for disposal and with the definite demand for recycled paperboard containers, it becomes desirable to provide means to collapse each container style quickly and efficiently.

In certain styles a built in collapsing mechanism is desirable where after use a person can readily act to collapse the erected container down into a flat condition. In providing a built in collapsing means the strength of the container cannot be adversely affected during use, either in top-to-bottom strength or in the strength of the bottom panel (sag).

A particular container style where the incorporated collapsing structure will be particularly useful is in the bliss style.

Accordingly, from the foregoing, one object of the present invention is the provision of structure within a paperboard container permitting quick collapse after use into a flat container.

Another object is the provision of the collapsing structure without an adverse impact on the container strength properties.

These and other objects of the present invention will be readily understood upon reviewing the detailed description to follow in conjunction with the attached drawings.

SUMMARY OF THE INVENTION

Briefly stated, the present invention is practiced in one form by providing a pair of opposed lines of weakness in each end wail of a paperboard container and spaced apart a distance greater than about fifty percent of the dimension between the side walls. The weakness lines serve as severance lines when an opposed force is exerted on the end walls allowing the central part of the end walls to tear away from the rest of the container.

BRIEF DESCRIPTION OF THE DRAWINGS

FIG. 1 illustrates the plan view of the body portion of a multipiece bliss style container.

FIG. 2 illustrates the plan view of the end wall portion of a multipiece bliss container.

FIG. 3 illustrates a cutaway detail plan view of one line of weakness in an end wall.

FIG. 4 shows an isometric view of the multipiece bliss container in its formed state ready for packing.

FIG. 5 shows an isometric view of the formed container being collapsed so as to allow it to lie flat.

DETAILED DESCRIPTION OF THE PREFERRED EMBODIMENT

Turning first to FIGS. 1 and 2 a well known container style which can utilize the present invention will be briefly described. A bliss style container is illustrated with the flat body blank shown generally at 10 in FIG. 1 and one of the two flat end wall blanks shown generally at 12 in FIG. 2. Body blank 10 is typical in that it has bottom wall 14 and two opposed side walls 16, 18 hinged thereto along hinge lines 20, 22 respectively. Opposed top closure panels 24, 26 are hinged to side walls 16, 18 along hinge lines 28, 30 respectively. Opposed glue panels 32, 34 and 36, 38 extend outwardly from the ends of the side walls and are hinged t hereto via a hinge line, each indicated at 40. Extending outwardly from the edges of bottom wall 14 are additional hinged glue panels 42, 44 and connected thereto by the hinge lines indicated as 46. In the preferred embodiment the length of glue panels 42, 44 is less than the width of bottom wall 14 and the reason will become apparent later.

In FIG. 2 end walls 12 have a width, of course, equal to the width of bottom wall 14 and a height equal to the height of side walls 16, 18. Extending from each side edge of an end wall will be glue panels 48, 50 via hinge lines 52. Glue panels 48, 50 become panels glued to the inside surface of the side walls while glue panels 32, 34; 36, 38; and 42, 44 will be glued to outside surfaces of the body.

Additional elements of the pair of end walls comprising the structure of the present invention include opposed weakened lines 54, 56 extending substantially in a straight line from the top to the bottom. Each weakened line is spaced inwardly from its respective hinge line 52 and the distance between the weakened lines 54, 56 is equal to or slightly greater than the width of glue panels 48, 50. Extending from the top edge of each end wall is an end closure panel 58, via hinge line 60. The straight opposed lines 62, 64 are cut free and do not form part of the hinge. As noted on FIG. 2, each line 62, 64 terminates at the top end of a weakened line. Referring to FIG. 3, detail of each weakened line is illustrated. Perforations are created while forming the container end wall blanks as illustrated with a vertical component 66 and an inclined portion 68. Such a perforated structure aids in the collapsing function as will be explained later.

In FIG. 4 a fully erected glued up bliss style container is shown which incorporates the present invention. After packing and use it should be retrieved and processed for recycling.

In FIG. 5 the container is shown being collapsed so it can be flattened for ease of collection and transport into the recycling process. To collapse the container two hands, as shown, simply grasp each end wail or the end closure panels and an opposed pulling force will cause the perforations forming the weakened lines to tear. The tearing is completed from top to bottom and thereafter the collapsed container can be laid out in flat condition. Even with the perforations formed in the end walls, the stacking strength is not adversely affected and with nothing done to the bottom wall, its integrity is maintained.

Thus, a paperboard container having means built in to allow ease of collapse has been described. The preferred embodiment has been illustrated and described. Modifications and improvements may occur to those skilled in the art and all such changes are intended to be included within the scope of the claims to follow.

I claim:

1. In an easily collapsible paperboard container of the type having upstanding side walls, a pair of opposed end walls with each upwardly extending edge of an end wall joined to its adjacent side wall and a bottom wall joining the bottom edges of the side walls and end walls; the improvement comprising:

a pair of opposed lines of weakness in each end wall spaced apart a distance equal to or greater than fifty percent of the dimension between the upwardly extending edges and extending upwardly from a point substantially at the bottom edge to a point substantially at the top of the end wall, which opposed lines of weakness will function as severance lines when the container is to be collapsed into a substantially horizontal plane by exerting opposing forces relative to the lines of weakness to cause severing throughout their lengths.

2. The improvement as in claim 1 in which the lines of weakness are comprised of vertical perforations in the paperboard.

3. The improvement as in claim 1 in which a top panel is connected to the top edge of each end wall between the lines of weakness.

* * * * *